US006478184B2

(12) United States Patent
Berge et al.

(10) Patent No.: US 6,478,184 B2
(45) Date of Patent: Nov. 12, 2002

(54) TWO PIECE HINGED CLOSURE

(75) Inventors: Gary Berge, Crystal Lake, IL (US); Thomas C. Stoneberg, Buffalo Grove, IL (US)

(73) Assignee: Courtesy Corporation, Buffalo Grove, IL (US)

( * ) Notice: Subject to any disclaimer, the term of this patent is extended or adjusted under 35 U.S.C. 154(b) by 31 days.

(21) Appl. No.: 09/768,735

(22) Filed: Jan. 24, 2001

(65) Prior Publication Data

US 2002/0096532 A1 Jul. 25, 2002

(51) Int. Cl.[7] ..... B65D 47/08
(52) U.S. Cl. ..... 220/831; 222/556; 215/235
(58) Field of Search ..... 220/831, 832, 220/847, 259.1; 215/235, 237; 222/556, 517

(56) References Cited

U.S. PATENT DOCUMENTS

| | | | | | |
|---|---|---|---|---|---|
| 4,158,902 | A | | 6/1979 | Chernack et al. | |
| 4,261,486 | A | * | 4/1981 | Bush et al. | 222/517 |
| 4,343,397 | A | * | 8/1982 | Nozawa et al. | 220/832 |
| 4,358,032 | A | * | 11/1982 | Libit | 222/556 |
| 4,513,888 | A | * | 4/1985 | Curry | 222/517 |
| 4,911,324 | A | | 3/1990 | Dubach | |
| 5,007,555 | A | | 4/1991 | Beck | |
| 5,271,536 | A | * | 12/1993 | Wilson | 222/517 |
| 5,335,802 | A | | 8/1994 | Brach et al. | |
| 5,358,130 | A | | 10/1994 | Mengeu et al. | |
| 5,735,418 | A | * | 4/1998 | Erb et al. | 215/235 |
| 5,996,859 | A | | 12/1999 | Beck | |
| 6,102,257 | A | * | 8/2000 | Goyet | 222/517 |
| 6,116,477 | A | | 9/2000 | Kreiseder et al. | |

* cited by examiner

*Primary Examiner*—Nathan J. Newhouse
(74) *Attorney, Agent, or Firm*—Silverman, Cass & Singer, Ltd.

(57) ABSTRACT

A two piece hinged closure for a container. The closure includes a base installed on the container and a hinged cap positioned on the base. The hinge of the cap includes a caming tab and the base includes a caming surface against which the tab moves when the cap is moved between its closed and open positions to retain the cap in said open position.

10 Claims, 9 Drawing Sheets

TWO PIECE HINGED CLOSURE

BACKGROUND OF THE INVENTION

1. Field of the Invention

This invention relates generally to dispensing closures for containers, and more particularly, to such closures which include a base portion and a separate hinge cap portion cooperatively engagable upon said base portion, the hinge of the hinge cap portion having a snap-action caming tab to retain the cap in open position and thereby permit dispensing of product from the container.

2. Description of the Prior Art

Two piece closures for containers are known and usually include a base portion adapted to be positioned on the mouth of the container and a separately formed cap portion which is cooperatively engagable upon said base portion to complete the closure. Formation of such closures from separate cap and base portions is desirable and advantageous because, where such closures are formed of molded plastic material, the two portions may be produced using molds which are less complicated and expensive than molds required for forming one piece closures, and also, the two separate portions may be molded from different color plastic material.

Hinged dispensing closures for containers also are known, as represented in the prior art patents of record herein. Such closures commonly include a pivotally mounted cap hingedly connected to a base and capable of being moved between a closed and an open dispensing position. In the closed position, the cap covers a dispensing opening formed in the base, and in the open position, the cap is moved away from the opening to permit product to be dispensed from the container.

Prior art closures with pivotally mounted caps also are known to include hinge constructions to maintain the cap in open position away from the base without an outside restraining force, and also to maintain the cap in closed position over the base such as by friction fit of matingly engagable parts between the cap and the base. Representative illustrations of such relevant closures are disclosed in U.S. Pat. Nos. 5,007,555, 5,996,859 and 6,116,447 which are owned by the same assignee or a subsidiary thereof as the assignee of the present application. The disclosures of said commonly owned patents hereby are incorporated herein by reference.

It is desirable to provide a convenient and expedient structure for causing the cap of such closures to snap open with respect to a container or a closure base on which the cap is positioned and thereby permit dispensing of the contents of the container through the closure. Preferably, such structure is formed from separately molded cap and base portions which are assembled together to provide the desired closure. Alternatively, the cap portion alone may be positioned directly upon a container to function as intended without the need for an associated base portion. Also, preferably, the cap portion of the closure is molded initially in its closed position or configuration which reduces the size of mold cavities required to produce same and thereby contribute to economy of manufacture.

SUMMARY OF THE INVENTION

The invention is characterized by a two piece hinged closure including a base portion and a separately formed cap portion. The cap portion includes an attachment skirt and a hinge connecting the skirt to the cap. The base portion is adapted to be secured to the mouth of a container and includes a spout surrounded by a skirt. The skirt of the cap is matingly engagable upon the skirt of the base to hold the cap securely upon the base when the cap is assembled therewith. The so assembled cap and base forms the two piece hinge closure of the invention in which the cap is movable between open and closed positions by pivoting the cap with respect to the base about the hinge connected between the cap and its associated skirt.

The hinge includes a caming tab centrally located between hinge straps connecting the cap to its associated skirt. The caming tab is engagable against an abutment or cam surface formed upon the base such that, when the cap is pivoted to its open position, the caming tab snaps over the abutment surface and thereby retains the cap in said open position.

Various objects and advantages of the invention will become apparent in accordance with the above and ensuing disclosure in which a preferred embodiment is described in detail in the specification and illustrated in accompanying drawings. It is contemplated that minor variations may occur to persons skilled in the art without departing from the scope or sacrificing any of the advantages of the invention.

DESCRIPTION OF THE PREFERRED EMBODIMENT

Figure 1:
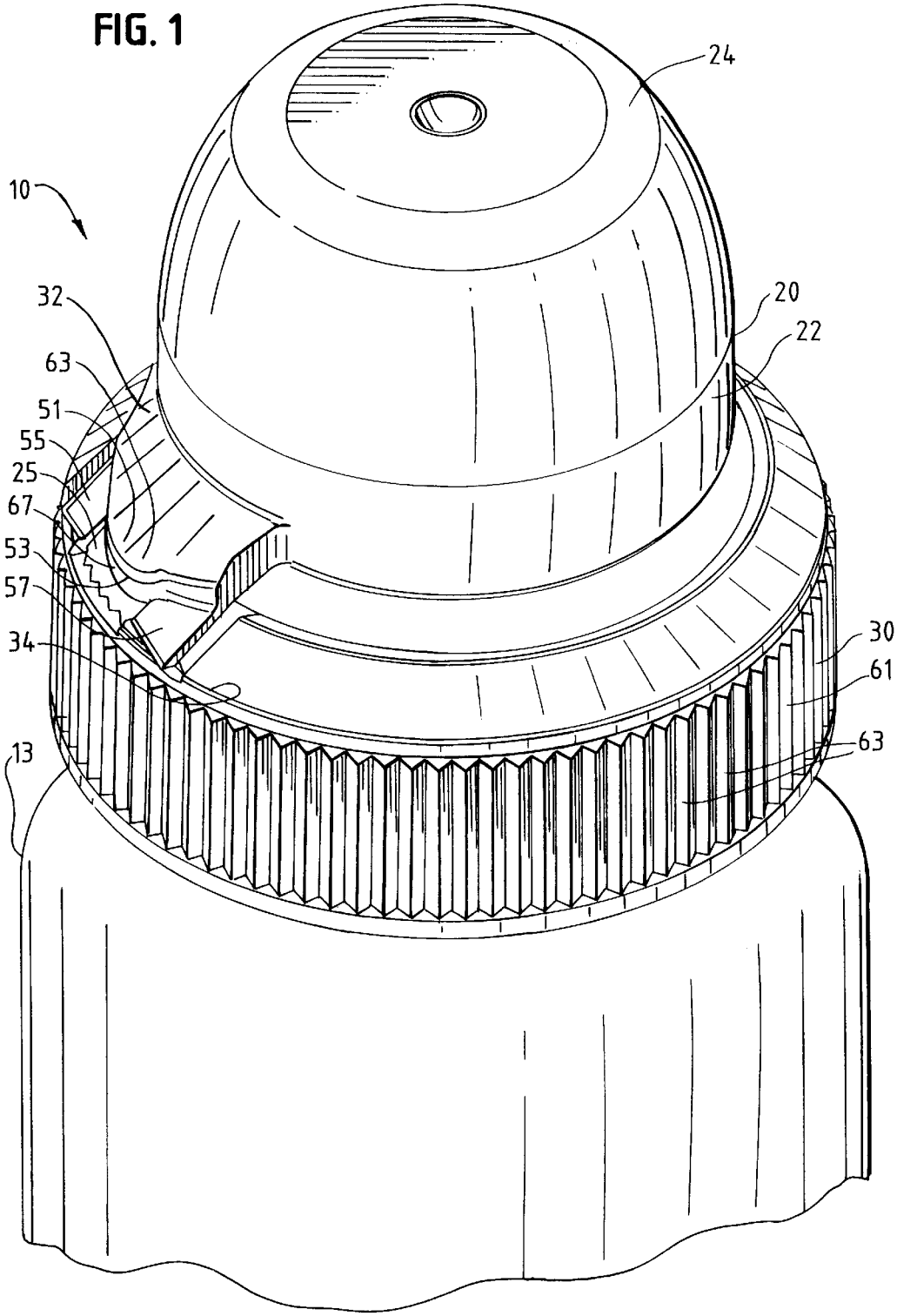
FIG. 1 is a perspective view of the two piece hinged closure of the invention, in which the cap is shown in its closed position with respect to the base.

Referring to the drawings, the two piece hinged closure 10 of the invention preferably is formed of molded plastic material and includes a base 12 with an upstanding spout 14. The base 12 is adapted for attachment to the mouth of a container 13 in known manner, such as by screw threads 16 (see FIG. 3) formed on the inner surface of the base 12 which mate with like threads on the mouth of the container.

Figure 2:
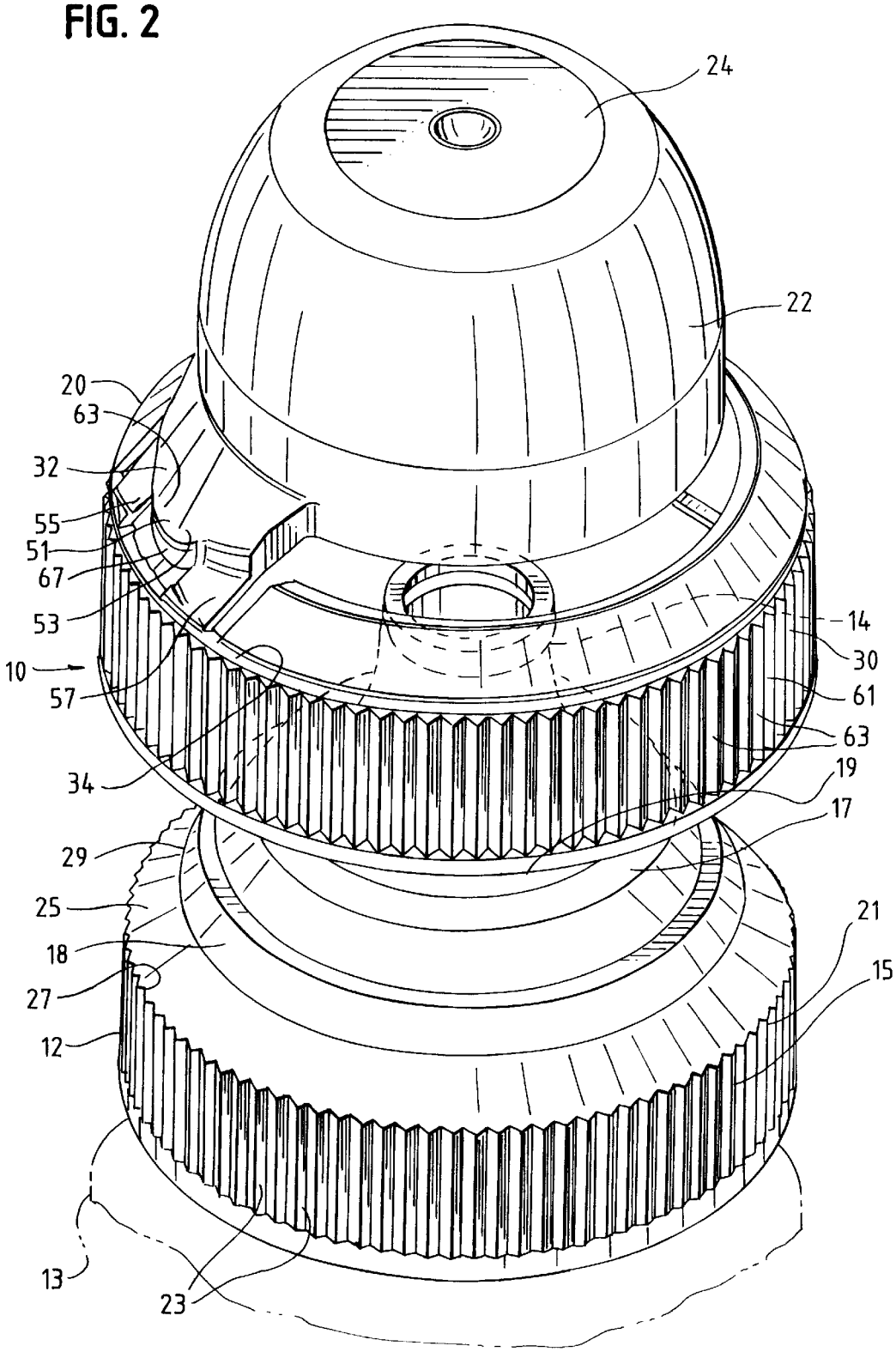
FIG. 2 is an exploded perspective view of the closure shown in FIG. 1, with the cap portion separated from its associated base portion.

As best seen in FIG. 2, base 12 includes a cylindrical skirt part 15 connected to a top wall portion 17 upon the top side 19 of which is formed spout 14. A circular ledge 18 is formed upon top wall portion 17 and substantially surrounds spout 14.

A caming abutment surface 25 is formed on base 12 and extends circumferentially thereabout between the top edge 27 of skirt 15 and the bottom edge 29 of ledge 18. The diameter of caming surface 25 proximate to the bottom edge 29 of ledge 18 is less than the diameter of said caming surface proximate to the top edge 27 of skirt 15. As such, the caming surface 25 is disposed along an inclined or canted plane with respect to the plane of skirt 15.

The external surface 21 of skirt 15 is formed with knurls or splines 23, for the purpose described hereinbelow.

Figure 3:
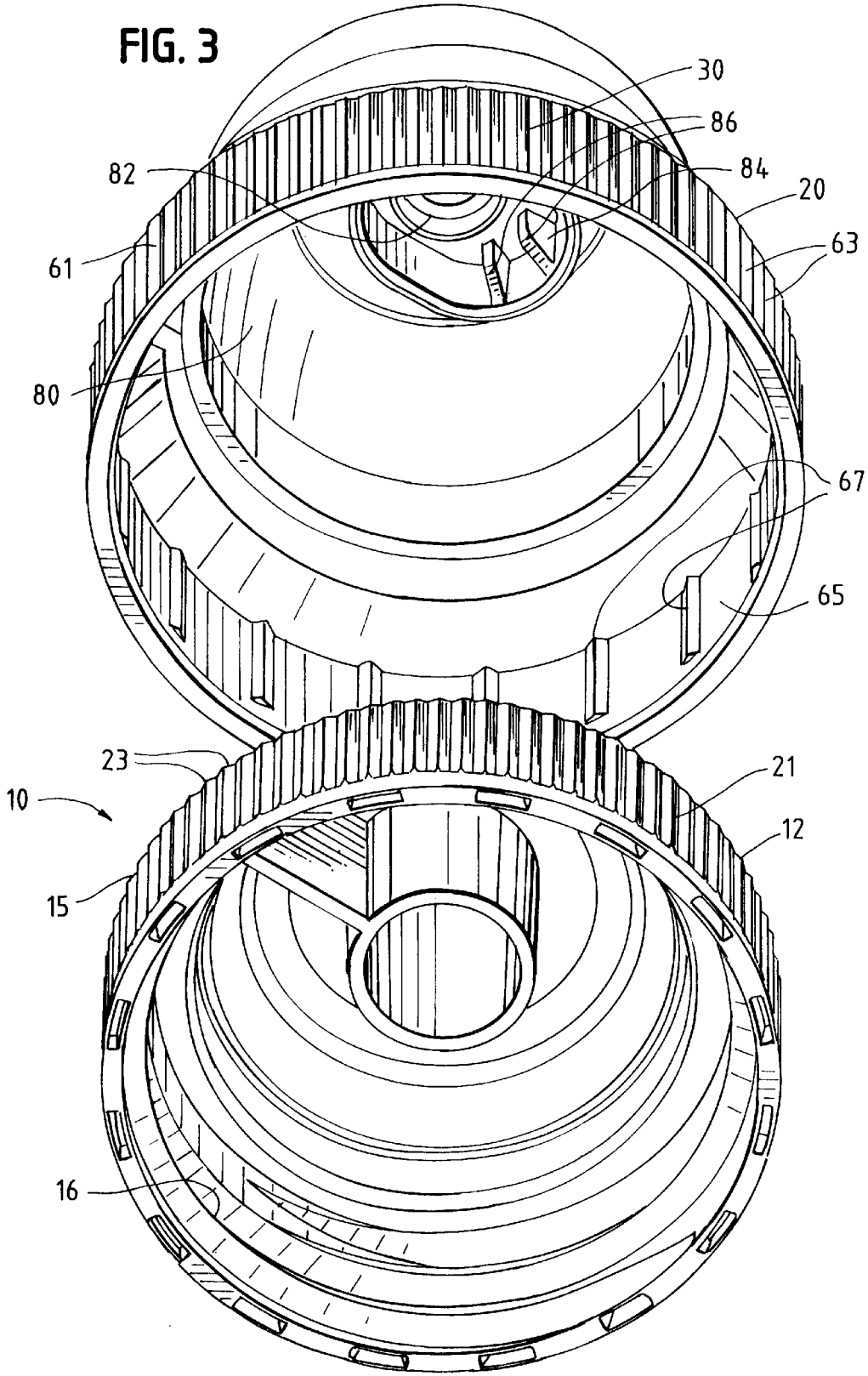
FIG. 3 is an exploded perspective view showing the undersides of the cap and base portions.

Cap 20 is molded separately from base 12, preferably in the closed position shown in FIGS. 1–3, and is provided for cooperative engagement by assembly with base 12 to form the a closure 10. Cap 20 includes a cylindrical wall 22 with a container closing portion in the form of a top wall 24 covering the cylindrical wall 22.

Cylindrical skirt 30 is formed integrally with cap 20 and is connected thereto by hinge 32. Hinge 32 includes cam tab 51 having a free edge 53, and hinge straps 55, 57 which are positioned on opposite sides of tab 51 and join cap 20 to skirt 30 along edge part 34 of skirt 30 and cylindrical wall 22 of the cap 20.

The external surface 61 of skirt 30 is formed with knurls 63 to facilitate grasping thereof by a user, and the internal surface 65 of skirt 30 is formed with ribs 67 spaced therealong and adapted for mating engagement with knurls or splines 23 formed on external surface 21 of base skirt 15 (see FIG. 3).

Separately molded cap 20 and base 12 are assembled together to form closure 10 by positioning skirt 30 of cap 20 over skirt 15 of base 12. Ribs 67 engage upon knurls or splines 23 to rigidly secure cap 20 to base 12. In such assembled position, hinge 32 is disposed proximate to caming or abutment surface 25 with free edge 53 of cam tab 51 engaged against the caming surface 25.

As best seen in FIGS. 10–13, free edge 53 of cam tab 51 includes top surface 63 and oppositely disposed bottom surface 65, with the top and bottom surfaces being oriented generally parallel to each other. Connecting surface 67 joins top and bottom surfaces 63, 65 along an inclined plane with respect to said top and bottom surfaces.

Figure 4:
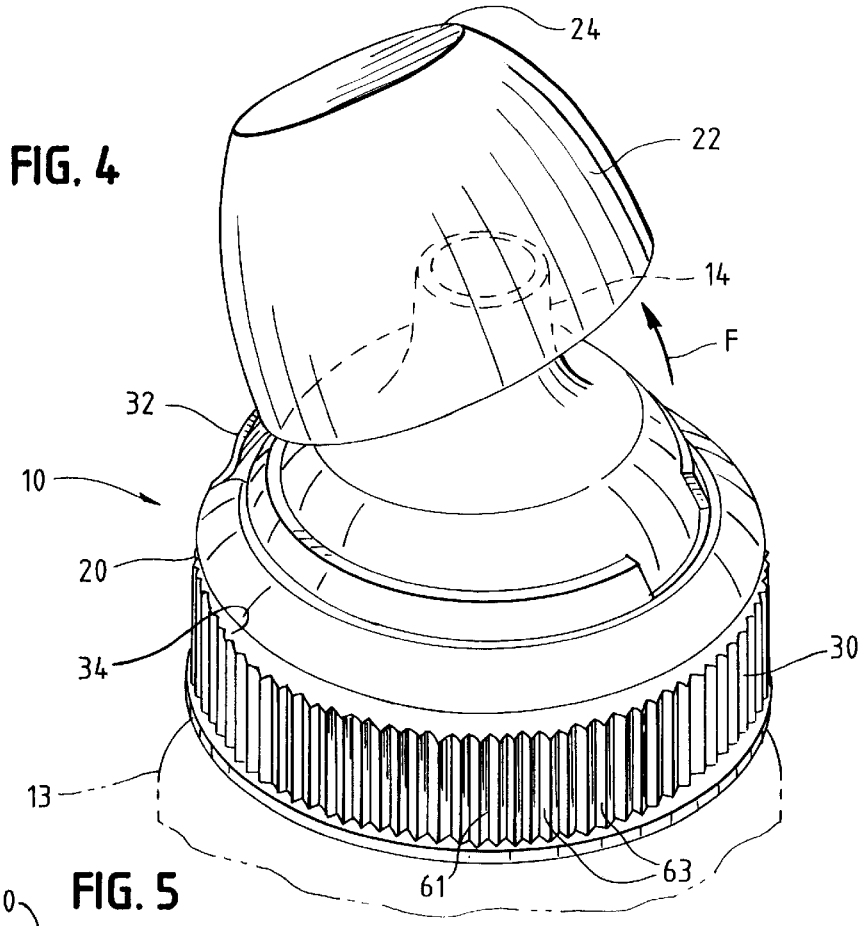
FIG. 4 is a perspective view of the closure shown in FIG. 1, partially in phantom outline, with the cap moved to a partially open position with respect to the base.
Figure 5:
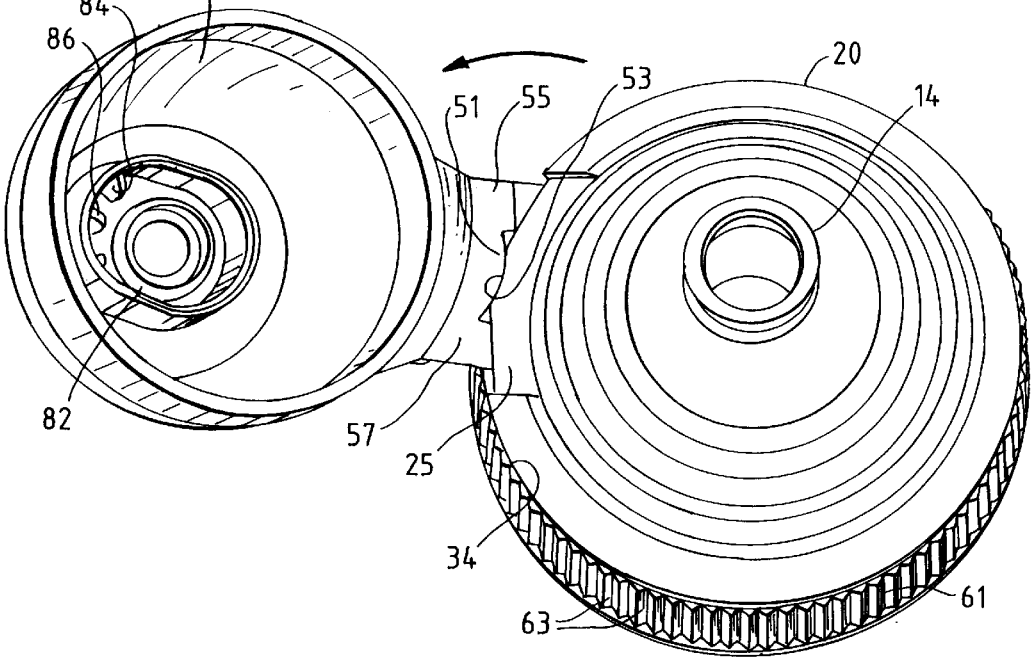
FIG. 5 is a perspective view of the closure of the invention showing the underside of the cap, the same having been moved to a further open position with respect to that shown in FIG. 4.
Figure 6:
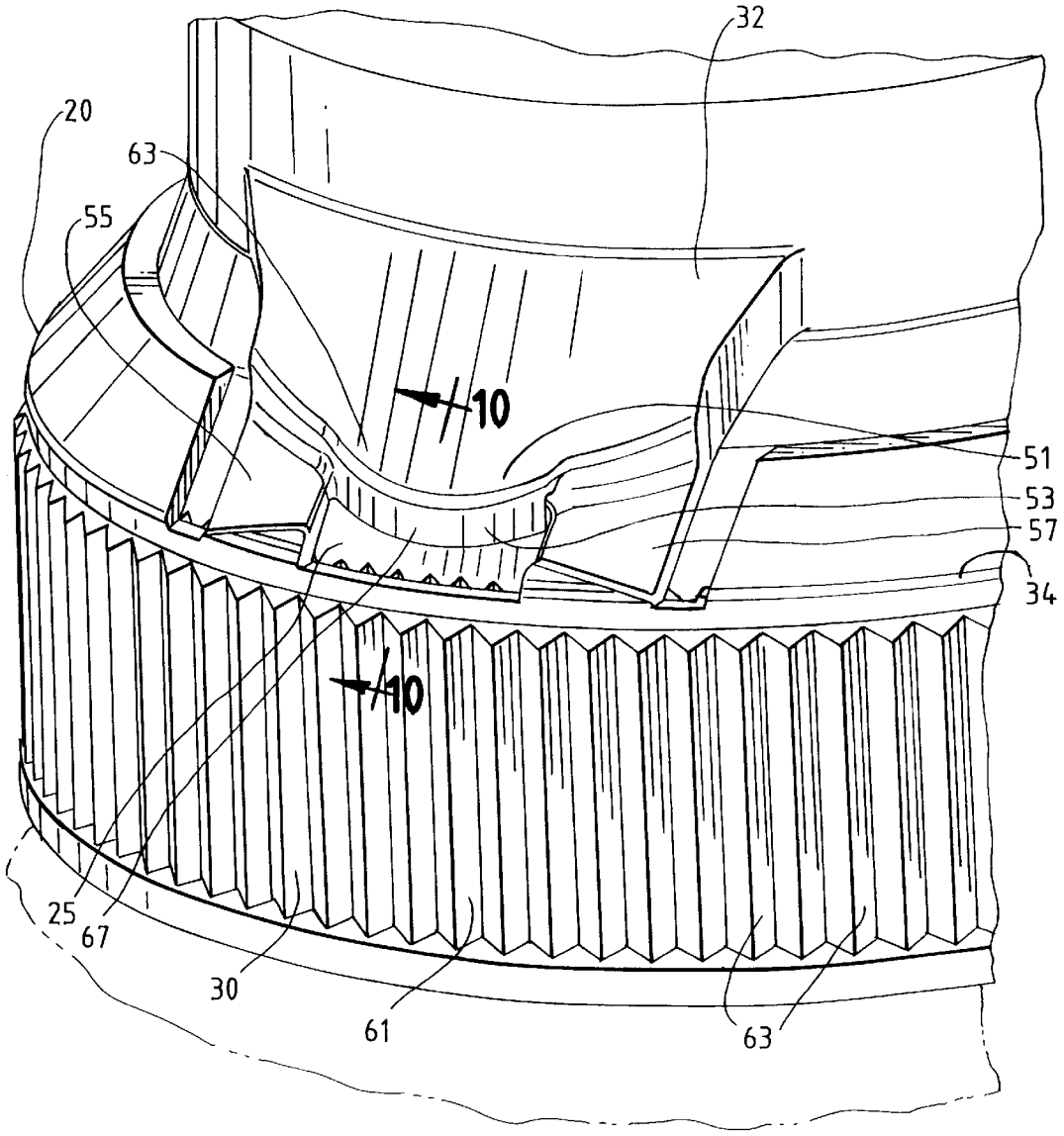
FIG. 6 is an enlarged perspective view of a fragment of the closure of the invention showing in detail the hinge elements thereof when the cap is in its closed position with respect to the base.
Figure 7:
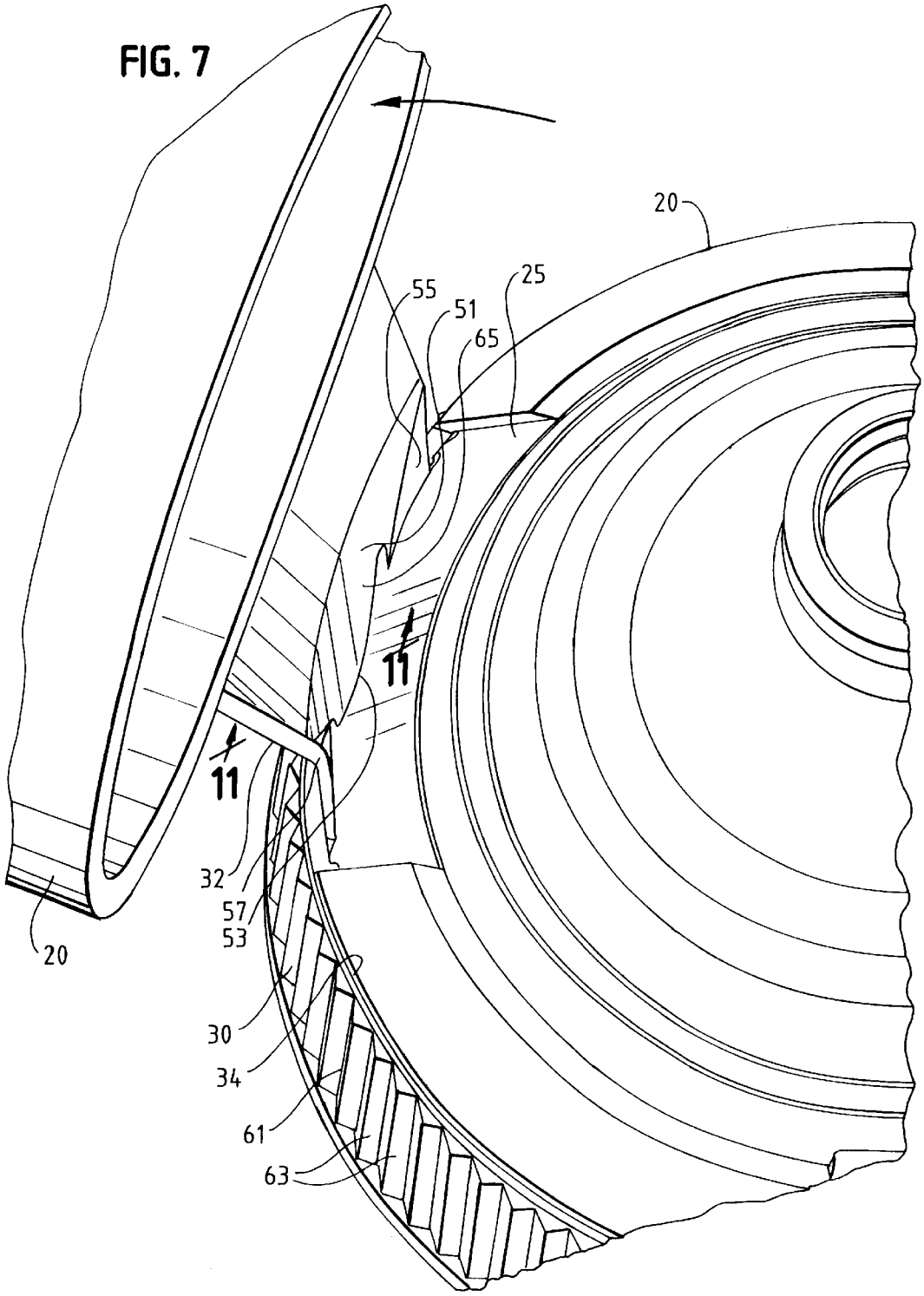
FIG. 7 is an enlarged perspective view of a fragment of the closure of the invention showing in detail the hinge elements thereof when the cap is moved toward its open position with respect to the base.
Figure 8:
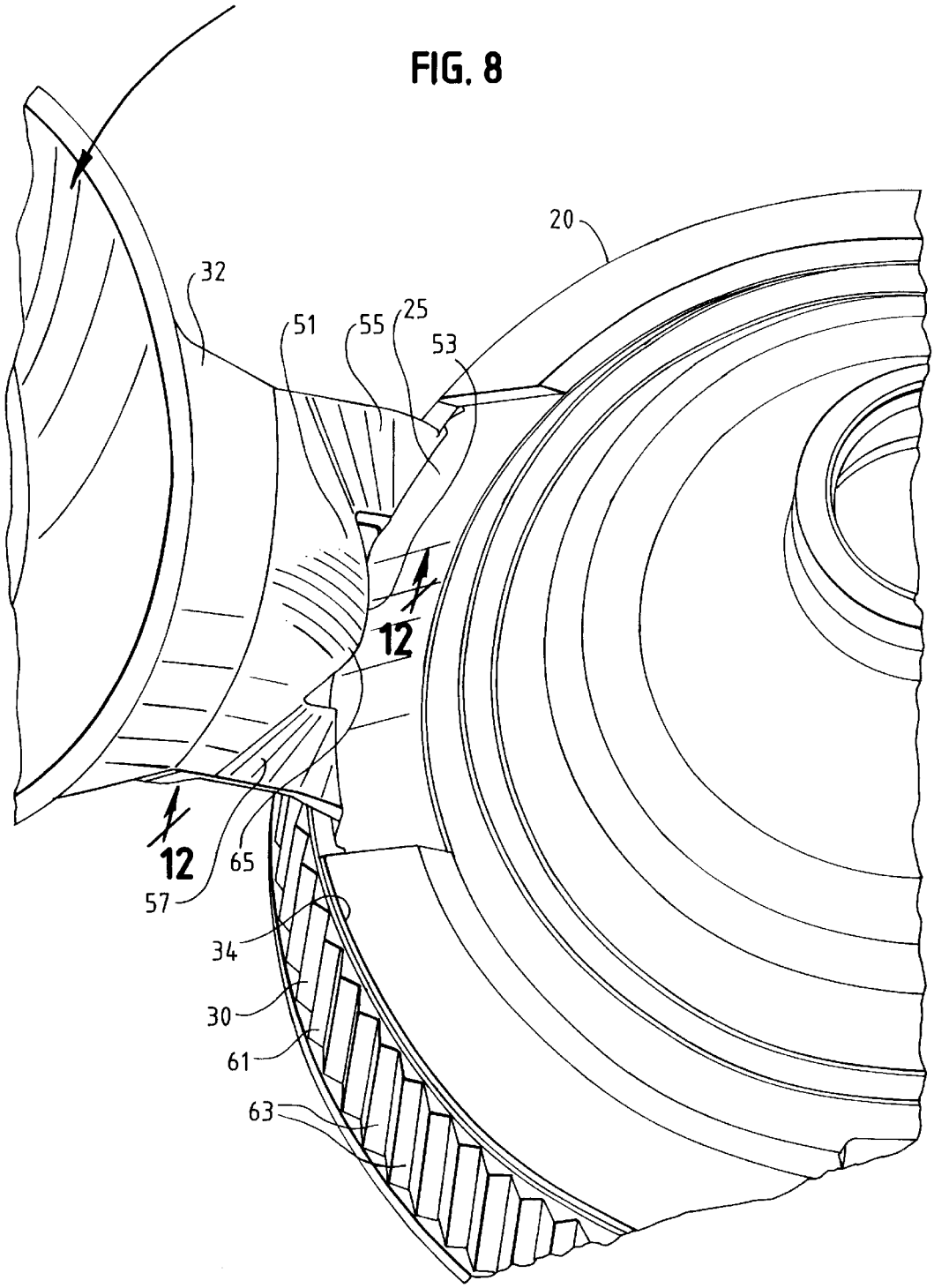
FIG. 8 is a view similar to that of FIG. 7, showing the hinge elements when the cap has been moved to a further open position with respect to that shown in FIG. 7.
Figure 9:
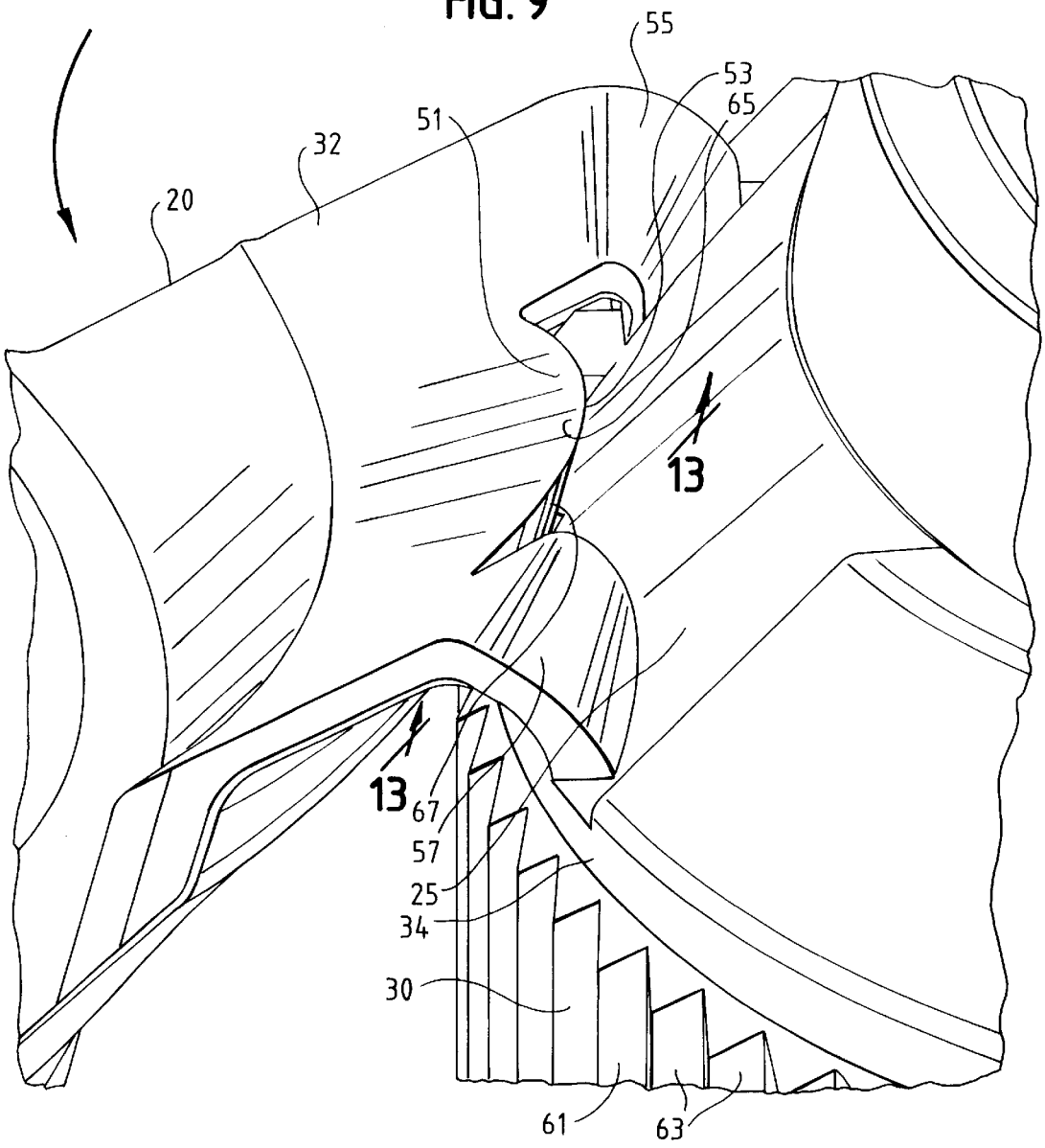
FIG. 9 is a view similar to that of FIG. 8, showing the hinge elements when the cap has been moved to its open position with respect to the base.
Figure 10:
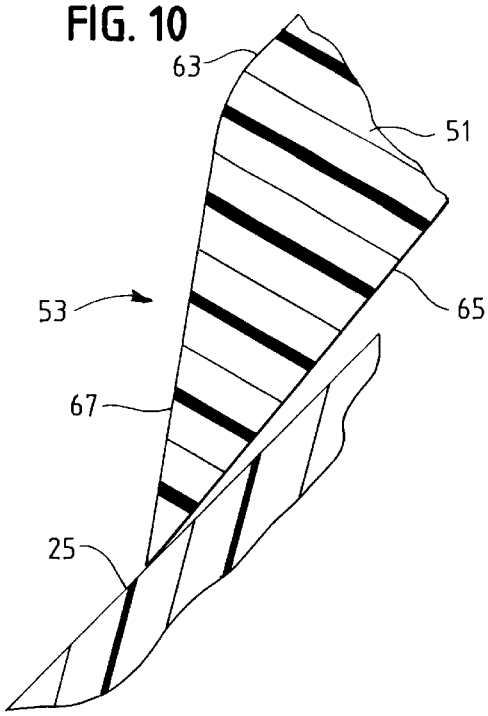
FIG. 10 is a sectional view taken along the line 10—10 of FIG. 6, in the direction indicated generally.
Figure 11:
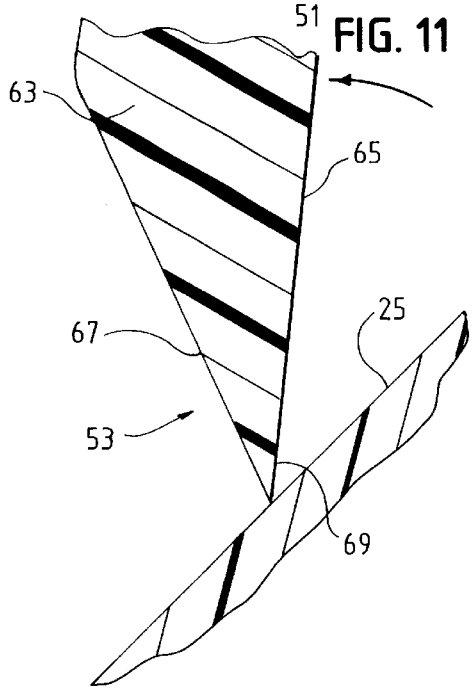
FIG. 11 is a sectional view taken along the line 11—11 of FIG. 7, in the direction indicated generally.

When cap 20 is assembled upon base 12 by positioning of cap skirt 30 upon base skirt 15, the cap is movable between its closed position seen in FIGS. 1–3 and its open position seen in FIGS. 4, 5 and 9 by pivoting the cap about hinge 32. The user asserts a force F (see FIG. 4) upon the cap 20 at a location opposite that of hinge 32 to pivot the cap about the hinge. During such operation, free edge 53 of cam tab 51 moves through the stages shown in FIGS. 10–13. As seen in FIG. 10, wherein the cap 20 is in its fully closed position with respect to base 12, bottom surface 65 is disposed adjacent to cam surface 25. Upon opening of cap 20, bottom surface 65 moves away from cam surface 25 (FIG. 11) and pivots along its terminal end 69. Simultaneously, hinge straps 55, 57 stretch (see FIG. 8) and the terminal end 69 of bottom surface 65 slides along cam surface 25 (see FIG. 12). Continued movement of cap 20 causes terminal end 69 to snap along cam surface 25 such that connecting surface 67 rests against cam surface 25 to hold cap 20 in its open position. The cap is moved to its closed position over base 12 by reversing the above procedure.

The underside 80 of cap 20 has formed thereon a depending plug 82 with associated guide ribs 84 having canted edges 86 which engage against spout 14 when the cap is moved to its closed position over base 12 (see FIGS. 3 and 5). The guide ribs 84 direct the plug 82 to properly engage spout 14 and thereby prevent damage to the spout when the plug is so engaged thereover.

Figure 12:
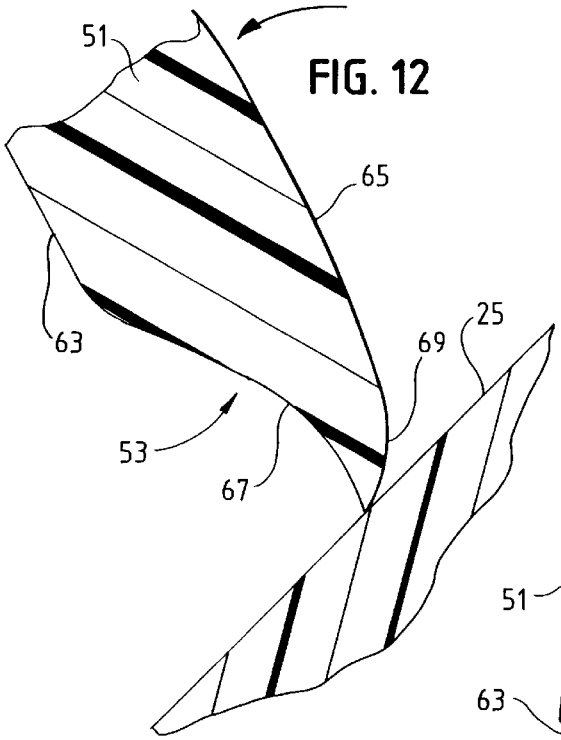
FIG. 12 is a sectional view taken along the line 12—12 of FIG. 8, in the direction indicated generally.
Figure 13:
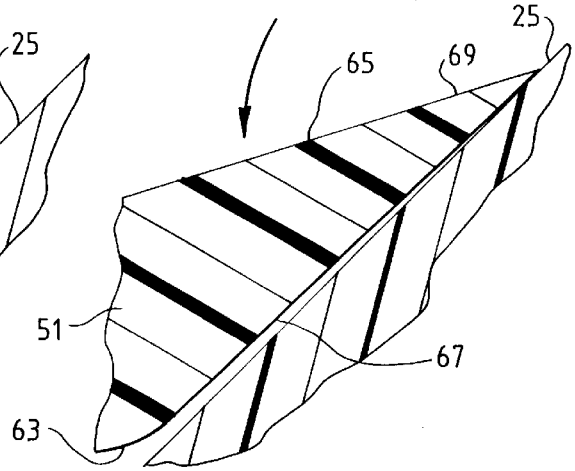
FIG. 13 is a sectional view taken along the line 13—13 of FIG. 9, in the direction indicated generally.

The elongate and other dimensions of cam tab 51 are chosen to provide sufficient interference fit between the tab and cam surface 25 and thereby to cause stretching of hinge straps 55, 57. Such interference fit between tab 51 and cam surface 25 results in a snap-action feel to the user during opening and closing of the cap 20. The snap-action feel is achieved when the free edge 53 of cam tab 51 interacts with cam surface 25 when the tab moves between partially closed position (FIG. 12) to fully closed position (FIG. 13) and snaps between the two positions. During such interactive movement, cam tab 51 remains substantially rigid and only the terminal end 69 flexes as seen in FIG. 12. The only portions of hinge 32 which stretch are the straps 55, 57, as seen in FIG. 9.

While cam surface 25 is shown as being located on base 12, it is to be understood that other locations are possible for such surface. For example, the cap 20 could be positioned directly upon the mouth of container 13 without the need for a separate base 12. In such event, cam surface 25 would be formed upon the container mouth.

Other configurations and variations in the structure, arrangement and size of the various parts may occur to those skilled in the art without department from the spirit or circumventing the scope of the invention as set forth in the appended claims.

What is claimed is:

1. A closure for a container having a mouth, said closure comprising, a cap including a container closing portion and a skirt to be positioned adjacent to and over said mouth, a hinge connecting said skirt to said container closing portion, said container closing portion, skirt and hinge being molded as a single piece, a hinge abutment surface on said skirt positioned upon said mouth and along a sloped plane inclined with respect to a vertical axis of said mouth, said hinge including a flexible cam tab with a free edge engaged against said inclined abutment surface, a pair of opposed hinge straps located on either side of said cam tab, whereby movement of said cap between a first closed position on said mouth and a second open position causes said hinge straps to stretch and said cam tab to move along said hinge abutment surface and to snap over center to retain said cap in said open position, said cam tab resting against and generally parallel with respect to said abutment surface in said open position.

2. A closure as claimed in claim 1 including a base mounted on said mouth, said cap being removably positioned upon said base, the hinge abutment surface being formed on said base.

3. A closure as claimed in claim 2 in which the cam tab has a top surface and a bottom surface, and a connecting surface joining said top and bottom surfaces along an inclined plane with respect to the top and bottom surfaces.

4. A closure as claimed in claim 3 in which the connecting surface rests against the hinge abutment surface when the cap is in its open position.

5. A closure as claimed in claim 4 in which the cam tab engages the hinge abutment surface in interference fit.

6. In combination with a container having a mouth, a closure for said container, said combination comprising, a cap including a container closing portion and a skirt to be positioned adjacent to and over said mouth, a hinge connecting said skirt to said container closing portion, said container closing portion, skirt and hinge being molded as a single piece, a hinge abutment surface on said skirt positioned upon said mouth and along a sloped plane inclined with respect to a vertical axis of said mouth, said hinge including a flexible cam tab with a free edge engaged against said inclined abutment surface, a pair of opposed hinge straps located on either side of said cam tab, whereby movement of said cap between a first closed position on said mouth and a second open position causes said hinge straps to stretch and said cam tab to move along said hinge abutment surface and to snap over center to retain said cap in said open position, said cam tab resting against and generally parallel with respect to said abutment surface in said open position.

7. The combination as claimed in claim 6 including a base mounted on said mouth, said cap being positioned upon said base, the hinge abutment surface being formed on said base.

8. The combination as claimed in claim 7 in which the free edge of the cam tab has a top surface and a bottom surface oriented generally parallel to the top surface, and a connecting surface joining said top and bottom surfaces along an inclined plane with respect to said top and bottom surfaces.

9. The combination as claimed in claim 8 in which the connecting surface rests against the hinge abutment surface when the cap is in its open position.

10. The combination as claimed in claim 9 in which the cam tab engages the hinge abutment surface in interference fit.

* * * * *